US009138049B2

(12) United States Patent
Maragos et al.

(10) Patent No.: US 9,138,049 B2
(45) Date of Patent: Sep. 22, 2015

(54) PAINTBRUSH CLEANING DEVICE

(71) Applicant: Mass Orange Designs, LLC, West Orange, NJ (US)

(72) Inventors: Spiros Maragos, West Orange, NJ (US); Matthew Rossi, New York, NY (US)

(73) Assignee: MASS ORANGE DESIGNS, LLC, West Orange, NJ (US)

( * ) Notice: Subject to any disclaimer, the term of this patent is extended or adjusted under 35 U.S.C. 154(b) by 21 days.

(21) Appl. No.: 13/760,553

(22) Filed: Feb. 6, 2013

(65) Prior Publication Data

US 2014/0215744 A1 Aug. 7, 2014

(51) Int. Cl.

| | |
|---|---|
| ***B65D 90/00*** | (2006.01) |
| ***B65D 25/00*** | (2006.01) |
| ***A46B 17/06*** | (2006.01) |

(52) U.S. Cl.

CPC ..... *A46B 17/06* (2013.01); *A46B 2200/202* (2013.01)

(58) Field of Classification Search

CPC ..... B44D 3/12; B44D 3/123; B44D 3/164; B44D 3/163; B44D 3/16; A46B 17/06

USPC ..... 220/695, 697, 700; 248/113

See application file for complete search history.

(56) References Cited

U.S. PATENT DOCUMENTS

| | | | | |
|---|---|---|---|---|
| 2,284,452 | A | | 5/1942 | Simons |
| 2,321,492 | A | | 6/1943 | Kinney |
| 2,466,850 | A | | 4/1949 | Hoffman |
| 2,469,864 | A | | 5/1949 | Craft |
| 2,483,265 | A | | 9/1949 | Delia |
| 2,487,990 | A | | 11/1949 | Soens |
| 2,675,979 | A | * | 4/1954 | Vetterli et al. ..... 248/113 |
| 2,699,882 | A | | 1/1955 | Lieb |
| 2,803,374 | A | | 8/1957 | Chappman |
| 3,519,305 | A | * | 7/1970 | Gardner et al. ..... 294/101 |
| 3,536,187 | A | * | 10/1970 | Stafford ..... 206/361 |
| 3,641,615 | A | | 2/1972 | Peasley |
| 3,948,413 | A | | 4/1976 | Gorrell et al. |
| 4,014,453 | A | | 3/1977 | Tarnacki |
| 4,275,818 | A | | 6/1981 | Church |
| 4,561,556 | A | | 12/1985 | Bendix |
| 4,832,293 | A | | 5/1989 | Gizzi |
| 4,991,803 | A | * | 2/1991 | Buder ..... 248/113 |
| 4,993,671 | A | * | 2/1991 | Ste. Marie ..... 248/113 |
| 5,035,387 | A | | 7/1991 | Gizzi |

(Continued)

FOREIGN PATENT DOCUMENTS

| | | | |
|---|---|---|---|
| GB | 2174673 | A | 11/1986 |
| GB | 2237788 | A | 5/1991 |

(Continued)

*Primary Examiner* — Anthony Stashick
*Assistant Examiner* — Blaine Neway
(74) *Attorney, Agent, or Firm* — Arent Fox LLP

(57) ABSTRACT

A paint removal device that allows for the removal of excess paint from a paintbrush for cleaner and more efficient painting. The paint removal device contains an attachment member to allow for the device to be secured to a lip of a paint can, and a removal member that includes a pair of arms extends laterally away from the clip portion. When attached to a paint can, the paint removal member is positioned to allow for a painter to draw the paintbrush against the side of the arms of the paint removal member to remove the excess paint from the paintbrush bristles after inserting the paintbrush into the paint supply.

8 Claims, 3 Drawing Sheets

(56) References Cited

U.S. PATENT DOCUMENTS

| | | | | |
|---|---|---|---|---|
| 5,085,386 | A | 2/1992 | Hicks et al. | |
| 5,297,695 | A | 3/1994 | Provence | |
| D358,691 | S * | 5/1995 | Engle | D32/54 |
| D366,741 | S * | 1/1996 | Roehrig | D32/54 |
| 5,806,818 | A | 9/1998 | Heywood | |
| 5,823,483 | A * | 10/1998 | Gaskill | 248/37.6 |
| 6,419,194 | B1 * | 7/2002 | LoSacco et al. | 248/113 |
| 6,681,952 | B2 | 1/2004 | Mowe | |
| 6,820,848 | B1 | 11/2004 | Adam | |
| 6,871,825 | B2 | 3/2005 | Song | |
| 6,929,225 | B1 | 8/2005 | Kent | |
| 2006/0175488 | A1 | 8/2006 | Schmiddem et al. | |
| 2007/0018066 | A1 | 1/2007 | Thiel | |
| 2010/0116834 | A1 | 5/2010 | Sulick, Jr. | |

FOREIGN PATENT DOCUMENTS

| | | | |
|---|---|---|---|
| GB | 2366557 | A | 3/2002 |
| WO | WO-03-068532 | A1 | 8/2003 |

* cited by examiner

PAINTBRUSH CLEANING DEVICE

FIELD OF THE INVENTION

The present disclosure relates to a paint removal device, and more particularly, to a paint removal device that allows for the removal of excess paint from a paintbrush for cleaner and more efficient painting.

BACKGROUND OF THE INVENTION

A problem often encountered when using a paintbrush to paint is the accumulation of excess paint on the brush's bristles when the brush is inserted into the supply of paint. If the brush is used directly after being inserted into the paint, the excess paint will often drip, and the paint being applied to a surface can often be too thick and uneven. The common solution for this problem is for the painter to run the sides of the brush against a surface, for example, the inside lip of a paint can, to remove the excess paint from the brush. While improving the quality of the paint application, this practice leads to other problems. The excess paint often drips, runs down the side of the paint can, or enters the lip of the paint can, which can make the replacement of the paint can lid both messy and frustrating.

SUMMARY OF THE INVENTION

The present disclosure broadly comprises a device that can be removably attached to the inside lip of a paint can that allows for the removal of excess paint from the bristles of a paintbrush, while also preventing messy paint drips and allowing for easy replacement of the paint can lid once the painting is completed.

The device according to an aspect of the present invention contains a clip portion to allow for the removable attachment of the device to the lip of a paint can, and a removal member having at least one arm that extends laterally away from the clip portion. When attached, the paint removal member is positioned to allow for a painter to run the paintbrush against the side of the arms of the paint removal member to remove the excess paint from the paintbrush bristles after inserting the paintbrush into the paint supply. Much of the excess paint removed from the brush bristles returns to the paint supply in the can, therefore preventing paint drippage and the accumulation of paint on the lip and exterior of the paint can. The device also conserves paint by allowing excess paint applied to the bristles to be reused after being returned to the paint supply rather than being wasted.

In one embodiment, the clip portion is made up of an upper attachment portion and a lower attachment portion, wherein the upper attachment portion extends laterally over the top of the lip of the paint can, and is equipped with a protrusion extending downward that, when attached to a paint can, is positioned on the outside of the exterior wall of the paint can. The lower attachment portion is shaped to conform to the inner wall of the paint can, below the lip, when the device is attached to a paint can, to provide support for the paint removal device during use.

The shape and orientation of the paint removal member is variable. Provided that the arm(s) of the paint removal member is of sufficient length, width, and thickness to allow for successful removal of excess paint from a paintbrush during use, the invention is not otherwise limited.

In one exemplary embodiment, the paint removal member comprises two arms that extend laterally outward from the clip portion, substantially parallel for their entire length, so that when the device is attached to a paint can, the arms of the paint removal member extend toward the center of the paint can. In another exemplary embodiment, the two arms of the paint removal member extend parallel for a portion of their length, but flare outward at a point proximal to the tips of the paint removal members providing for increased spacing between the tips of the paint removal members. This design allows for easier insertion of the paintbrush between the paint removal members.

In yet another embodiment, a ridge is provided on one or both of the arms of the paint removal member. The ridge extends from the arm(s) of the paint removal member, and can be located anywhere along its width. The ridge assists in the paint removal process as the paintbrush is run across the surface of the paint removal member. In one embodiment, the ridge is positioned at the upper edge of the arm(s) of the paint removal member. In another embodiment, the ridge is positioned in the center of the arm(s) of the paint removal member.

The ridge can vary in length, shape, and cross section. For example, in one embodiment, a flat ridge extends from the first arm of the paint removal member along the entire length of the paint removal member. In another embodiment, a curved ridge extends from the paint removal member along the entire length of the paint removal member. In yet another embodiment, multiple ridges extend out from the arms of the paint removal member, extending along only a portion of the length of the arms of the paint removal member, and positioned at various places along the width of the paint removal member. In yet another embodiment, a ridge with a serrated edge extends from the paint removal member along the entire length of the paint removal member.

Further areas of applicability of the present disclosure will become apparent from the detailed description provided hereinafter. It should be understood that the detailed description, including disclosed embodiments and drawings, are mere exemplary in nature intended for purposes of illustration only and are not intended to limit the scope of the invention, its application or use. Thus, variations that do not depart from the gist of the invention are intended to be within the scope of the invention.

DETAILED DESCRIPTION OF THE INVENTION

Figure 1:
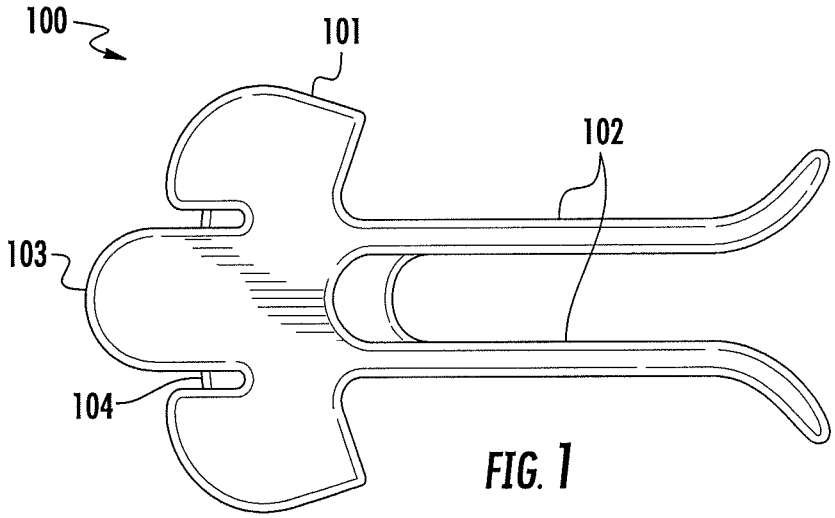
FIG. 1 is a top view of a paint removal device according to an embodiment of the present invention.
Figure 2:
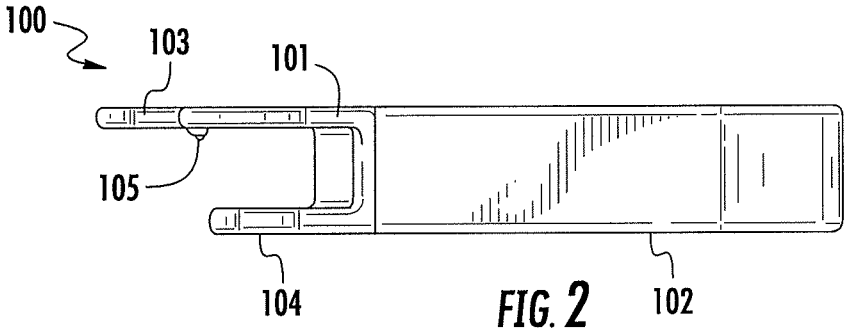
FIG. 2 is a side view of the paint removal device of FIG. 1.
Figure 3:
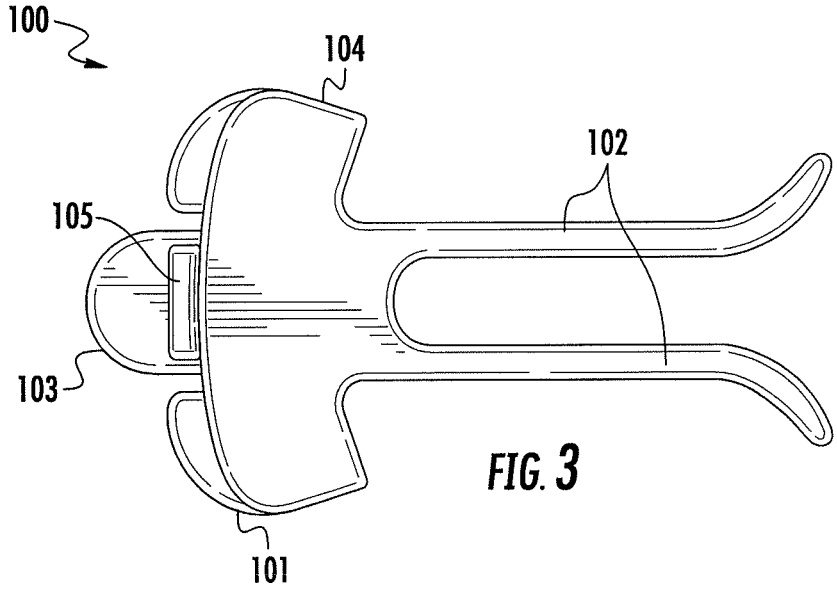
FIG. 3 is a bottom view of the paint removal device of FIG. 1.

FIGS. 1-3 show the paint removal device 100 according to a present embodiment. The paint removal device 100 can be removably attached to the inside lip of a paint can (not shown), and contains a clip portion 101, and a paint removal member 102 with two arms extending laterally away from the clip portion 101. The clip portion 101 is made up of an upper attachment portion 103 and a lower attachment portion 104, wherein the upper attachment portion 103 is supplied with a protrusion 105 extending downward, that, when attached to a paint can (not shown), is positioned on the outside of the exterior wall of the paint can. The lower attachment portion 104 is shaped to conform to the inner wall of the paint can to provide support for the paint removal device 100 during use. It should be understood that the lower attachment portion 104 extends under the lip of the paint can and the dimensions of the paint remove device 100, and, specifically, the clip portion 101, are provided to attached the device to a standard gallon of paint. However, it is contemplated that these dimensions can vary appropriately to accommodate various sizes of paint cans and the like. Furthermore, it should be appreciated that in alternative embodiments, varying securement mechanisms can be implemented to secure the paint removal device to the paint can.

In this exemplary embodiment, the paint removal member 102 comprises two arms that extend parallel for a portion of their length, but flare outward at a point proximal to the tip of the paint removal members 102, providing for increased spacing between the tips of the paint removal members 102. This design allows for easier insertion of the paintbrush between the paint removal members 102. It should be appreciated that the two paint removal members 102 could have the same length as shown in FIGS. 1-3 or varying lengths with respect to each other. In an alternative embodiment (not shown), it is contemplated that the paint removal member 102 can have a single arm extending toward the center of the paint can.

Figure 4:
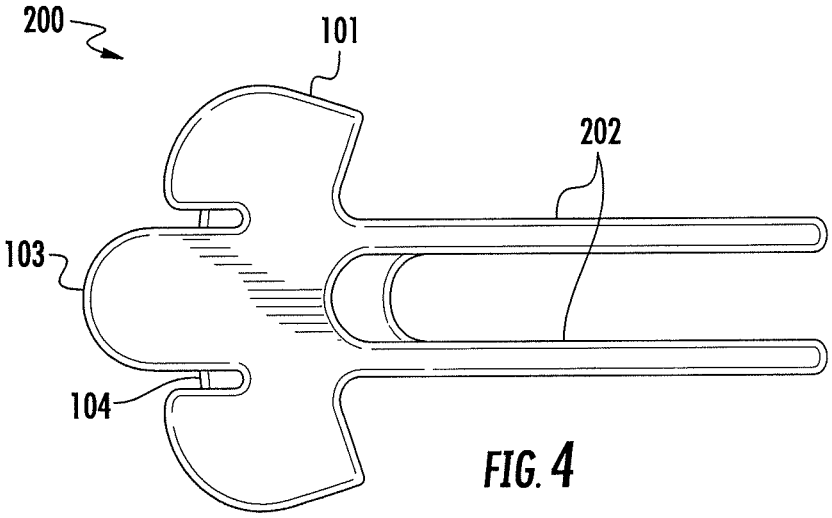
FIG. 4 is a top view of a second embodiment of a paint removal device according to the present invention.

FIG. 4 is a top view of a second embodiment of the paint removal device 200 according to the present invention. In this embodiment, the paint removal member 202 comprises two arms that extend laterally outward, parallel for their entire length. Otherwise, the paint removal device 200 includes the same components as those described above with respect to the embodiment shown in FIG. 1.

Figure 5:
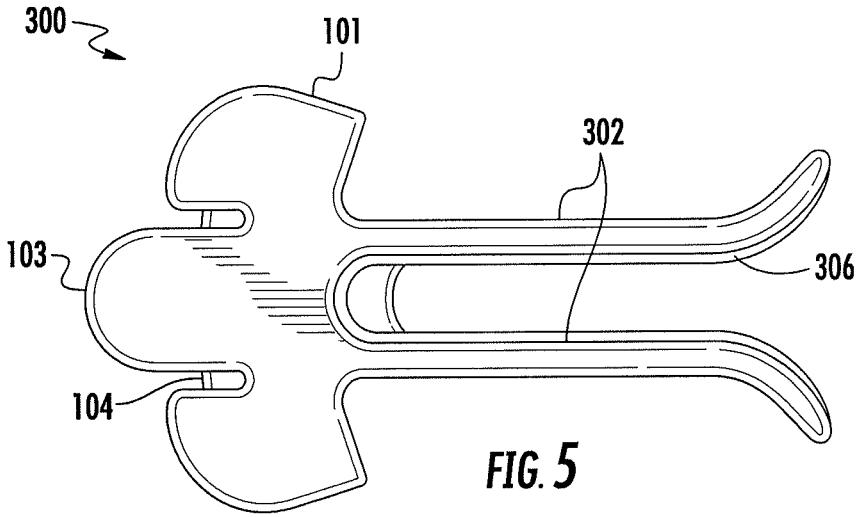
FIG. 5 is a top view of a third embodiment of a paint removal device according to the present invention.
Figure 6:
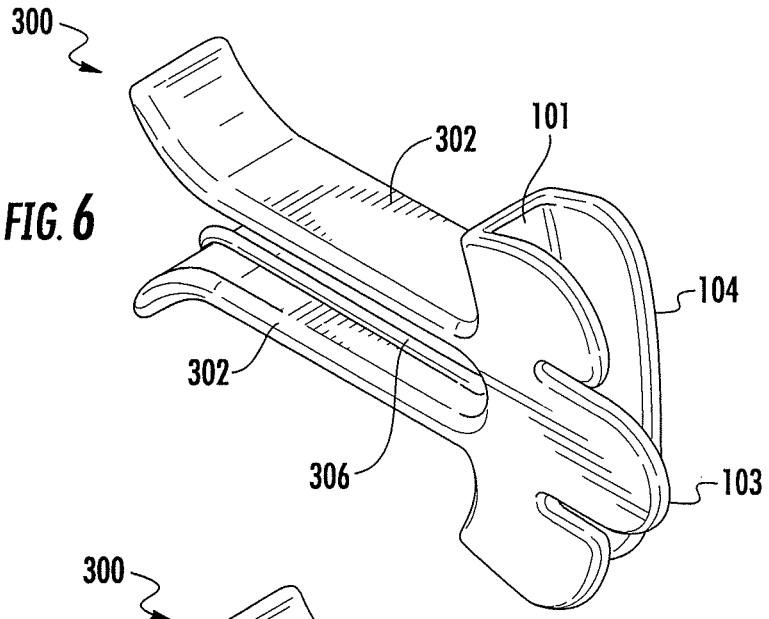
FIG. 6 is a perspective view of the paint removal device of FIG. 5.

FIGS. 5 and 6 show a third embodiment of the paint removal device 300 according to the present invention. A ridge 306 is provided on arms the paint removal members 302. The ridge 306 extends inward and a transverse direction from the inner surfaces of the arms of the paint removal member 302, and assists in the paint removal process as the paintbrush is drawn across the surface of the arms of the paint removal member 302. In this embodiment, the ridge 306 is positioned in the center of the arms of the paint removal member 302, and extends for the entire length of the paint removal member 302.

Figure 7:
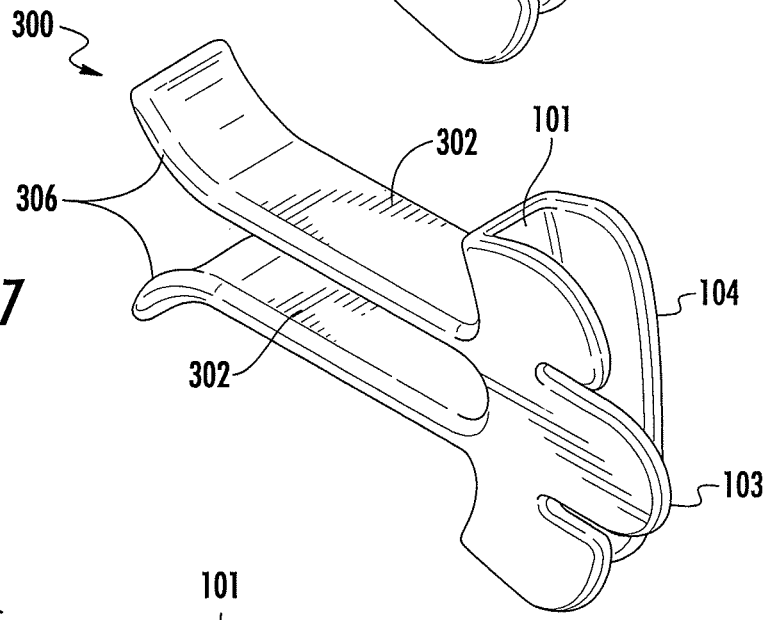
FIG. 7 is a perspective view of a fourth embodiment of a paint removal device according to the present invention.
Figure 8:
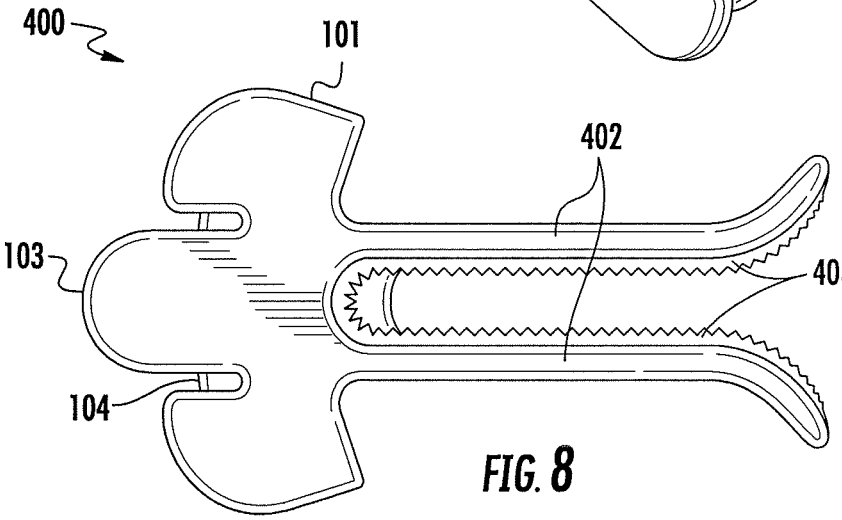
FIG. 8 is a top view of a fifth embodiment of a paint removal device according to the present invention.

It should be appreciated that the ridge 306 of the invention can vary in length, shape, and positioning on the arms of the paint removal member 302. For example, in one embodiment, the ridge 306 has a flat cross section. In another embodiment, the ridge 306 has a curved cross section and extends from the edge of the arms of the paint removal member 302 along the entire length, as is shown in FIG. 7. In yet another embodiment, multiple ridges 306 extend from the arms of the paint removal member 302, extending along only a portion of the paint removal member's length at various positions along the width of the paint removal member 302. In yet another embodiment, a ridge 406 with a serrated edge extends from the paint removal member 402, and extends along the entire length of the arms of the paint removal member 402 of the exemplary paint removal device 400, as shown in FIG. 8.

In the exemplary embodiments described above in which the paint removal member 102 comprises two extending arms, the spacing between the two arms of the paint removal member 102 can vary such that in one embodiment, the spacing is great enough so that only one side of the paintbrush has paint removed when the paintbrush is run between the arms of the paint removal member 102. In another embodiment, the spacing is reduced so that both sides of the paintbrush have adequate paint removed when the paintbrush is run between the arms of the paint removal members 102. In each of the embodiments, the paint removal device 100 is preferably fabricated from a solid material such as a plastic, metal, wood, or any other comparable conventionally known material.

While the foregoing has been described in conjunction with an exemplary embodiment, it is understood that the term "exemplary" is merely meant as an example. Accordingly, the application is intended to cover alternatives, modifications and equivalents, which may be included within the spirit and scope of the invention disclosed herein.

Additionally, in the preceding detailed description, numerous specific details have been set forth in order to provide a thorough understanding of the present invention. However, it should be apparent to one of ordinary skill in the art that the inventive paintbrush cleaning device may be practiced without these specific details. In other instances, well-known methods, procedures, and components have not been described in detail so as not to unnecessarily obscure aspects of the invention disclosed herein.

The invention claimed is:

1. A paint removal device comprising:

a clip portion configured to secure the paint removal device to a paint can, the clip portion including:

a base having a top portion and a bottom portion, a lower planar attachment arm extending laterally in a first direction from the bottom portion of the base and having an edge that is partially curved to conform to an inner surface of the paint can, an upper planar attachment arm extending laterally in the first direction from the top portion of the base, such that the lower and upper planar attachments arms extend in the first direction in parallel planes with respect to each other and the upper planar attachment arm has a length longer than the lower planar attachment arm, and a protrusion disposed at a position on a surface of the upper planar attachment arm that extends in a direction perpendicular to the surface of the upper planar attachment arm, where the position on the surface of the upper planar attachment arm does not overlap the lower planar attachment arm in a direction normal to the surface of the upper planar attachment arm, such that the protrusion is disposed outside an outer surface of the paint can when the paint removal device is attached thereto, a paint removal member having a pair of cleaning arms that extend laterally in a second direction opposite the first direction from the base of the clip portion and orthogonally to the parallel planes of the lower and upper planar attachment arms, the pair of cleaning arms extending parallel to each other, wherein at least one ridge extends transversely in the lateral direction along an inner surface of at least one cleaning arm.

2. The paint removal device of claim 1, wherein the pair of cleaning arms each extend parallel to each other for their entire lengths, respectively.

3. The paint removal device of claim 1, wherein a distal end of each of the pair of cleaning arms flare outwards with respect to each other.

4. The paint removal device of claim 1, wherein the ridge is positioned at an upper edge of at least one of the cleaning arms and extends along an entire length of the inner surface of the at least one cleaning arm.

5. The paint removal device of claim 1, wherein the ridge is positioned in the center of the width of at least one of the cleaning arms and extends along an entire length of the inner surface of the at least one cleaning arm.

6. The paint removal device of claim 1, wherein the ridge has a flat cross section.

7. The paint removal device of claim 1, wherein the ridge has a curved cross section.

8. The paint removal device of claim 1, wherein the ridge has a serrated edge.

* * * * *